US008520076B2

(12) United States Patent
Jang et al.

(10) Patent No.: US 8,520,076 B2
(45) Date of Patent: Aug. 27, 2013

(54) LIQUID CRYSTAL DISPLAY AND METHOD OF TESTING THE SAME

(75) Inventors: Chang Jae Jang, Gumi-si (KR); Chung Sik Kong, Gumi-si (KR)

(73) Assignee: LG Display Co., Ltd., Seoul (KR)

( * ) Notice: Subject to any disclaimer, the term of this patent is extended or adjusted under 35 U.S.C. 154(b) by 986 days.

(21) Appl. No.: 12/153,598

(22) Filed: May 21, 2008

(65) Prior Publication Data

US 2008/0309605 A1 Dec. 18, 2008

(30) Foreign Application Priority Data

Jun. 12, 2007 (KR) ..... 10-2007-0057069

(51) Int. Cl.
*G09G 3/36* (2006.01)

(52) U.S. Cl.
USPC ..... 348/189; 345/904; 345/87; 345/104; 324/403

(58) Field of Classification Search
USPC ..... 345/87–104
See application file for complete search history.

(56) References Cited

U.S. PATENT DOCUMENTS

| | | | | |
|---|---|---|---|---|
| 5,576,730 | A * | 11/1996 | Shimada et al. | 345/98 |
| 5,774,100 | A * | 6/1998 | Aoki et al. | 345/87 |
| 6,750,926 | B2 * | 6/2004 | Ohgiichi et al. | 349/40 |
| 7,205,986 | B2 * | 4/2007 | Osada | 345/204 |
| 2006/0092329 | A1 * | 5/2006 | Noji | 348/607 |

* cited by examiner

*Primary Examiner* — Alexander S Beck
*Assistant Examiner* — Jeffrey Steinberg
(74) *Attorney, Agent, or Firm* — McKenna Long & Aldridge, LLP

(57) ABSTRACT

A liquid crystal display is capable of detecting a failure of a gate driver, and a method of testing the same are provided. The liquid crystal display includes a liquid crystal display panel on which liquid crystal cells connected to thin film transistors (TFTs) located at crossings between gate lines and data lines are formed, a data driver that drives the data lines of the liquid crystal display panel, and a gate driver which includes first to nth stages (n is a natural number larger than 1) formed on the liquid crystal display panel that generates normal scan signals for turning on the TFTs in a normal mode, and that generates test scan signals for turning off the TFTs in a test mode.

4 Claims, 6 Drawing Sheets

LIQUID CRYSTAL DISPLAY AND METHOD OF TESTING THE SAME

This application claims the benefit of Korean Patent Application No. 2007-057069, filed on Jun. 12, 2007, which is hereby incorporated by reference for all purposes as if fully set forth herein.

BACKGROUND OF THE INVENTION

1. Field of the Invention

The present invention relates to liquid crystal display devices and more particularly to failure detection and testing of a liquid crystal display.

2. Discussion of the Related Art

Generally, a liquid crystal display (LCD) displays an image by adjusting light transmission of liquid crystal cells arranged in a matrix on a liquid crystal display panel according to video signals.

The liquid crystal display panel includes a thin film transistor (TFT) substrate and a color filter substrate bonded together by a sealant with liquid crystal interposed therebetween.

In the color filter substrate, a color filter array including a black matrix for preventing light leakage, a color filter for realizing color, a common electrode for generating a vertical electric field with a pixel electrode, and an upper alignment film that is coated thereon for aligning the liquid crystal is formed on an upper substrate.

In the TFT substrate, a TFT array includes a gate line and a data line formed to cross each other, a TFT formed at a crossing thereof, a pixel electrode connected to the TFT, and a lower alignment film that is coated thereon for aligning the liquid crystal is formed on a lower substrate. In particular, a gate driver may be simultaneously formed in a common process with the TFT in a peripheral region of the TFT substrate. An amorphous silicon TFT or a polysilicon TFT having high charge mobility is used in the TFT formed in the gate driver.

A typical method of manufacturing the liquid crystal display panel includes a patterning process for forming the TFT array and the color filter array, a sealing process for bonding the TFT substrate and the color filter substrate with liquid crystal interposed therebetween, and a testing process for detecting a faulty liquid crystal display panel.

In the testing process, the TFT is turned on in response to a scan signal generated by the gate driver and a test pixel signal is supplied from the data line to the liquid crystal cell via the TFT, such that a failure of the liquid crystal display panel is detected. When a failure occurs in a signal line of the liquid crystal display panel, a pixel connected to the signal line displays an image different from a pixel connected to a normal signal line and accordingly a failure state of the liquid crystal display panel can be easily detected.

However, using the related art methods of testing the liquid crystal display, it is not impossible to detect some failures of the gate driver that may occur while the gate driver is manufactured. That is, when a failure occurs in the gate driver, the gate driver may abnormally operate to output a scan signal having an abnormal level instead of a normal level the failure may not be detected. For example, when clock lines for supplying a plurality of clock signals to the gate driver are slightly short-circuited, a scan signal having an abnormal level between a low logic level and a high logic level may be generated by a stage that should generate a scan signal having a low logic level. The TFT operates in response to the scan signal having the abnormal level and thus the liquid crystal display panel is determined to be good. In the liquid crystal display panel that is determined to be good in spite of having a scan signal having the abnormal level, a failure phenomenon may occur in a driving environment or upon application of a specific driving pattern. The failure phenomenon may gradually become more serious so that a defect becomes visible to a user after the elapse of the time.

SUMMARY OF THE INVENTION

Accordingly, the present invention is directed to a liquid crystal display and a method of testing the same that substantially obviate one or more problems due to limitations and disadvantages of the related art.

An advantage of the present invention is to provide a liquid crystal display that is capable of detecting a failure of a gate driver, and a method of testing the same.

Additional advantages and features of the invention will be set forth in part in the description which follows and in part will become apparent to those having ordinary skill in the art upon examination of the following or may be learned from practice of the invention. These and other advantages of the invention may be realized and attained by the structure particularly pointed out in the written description and claims hereof as well as the appended drawings.

To achieve these and other advantages and in accordance with the purpose of the invention, as embodied and broadly described herein, a liquid crystal display includes a liquid crystal display panel on which liquid crystal cells connected to thin film transistors (TFTs) located at crossings between gate lines and data lines are formed; a data driver that drives the data lines of the liquid crystal display panel; and a gate driver that includes first to nth stages (n is a natural number larger than 1) formed on the liquid crystal display panel, generates normal scan signals for turning on the TFTs in a normal mode, and generates test scan signals for turning off the TFTs in a test mode.

In another aspect of the present invention, there is provided a method of testing a liquid crystal display including a liquid crystal display panel on which liquid crystal cells connected to thin film transistors (TFTs) located at crossings between gate lines and data lines are formed, the method including: sequentially test scan signals for turning off the TFTs, that are generated by a gate driver including first to nth stages formed on the liquid crystal display panel, to the gate lines of the liquid crystal display panel; supplying pixel voltage signals to the data lines of the liquid crystal display panel; and determining whether or not images corresponding to the pixel voltage signals are displayed on the liquid crystal display panel.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to the embodiments of the present invention, examples of which are illustrated in the accompanying drawings. Wherever possible, the same reference numbers will be used throughout the drawings to refer to the same or like parts.

Hereinafter, exemplary embodiments of the present invention will be described with reference to FIGS. 1 to 6.

Figure 1:
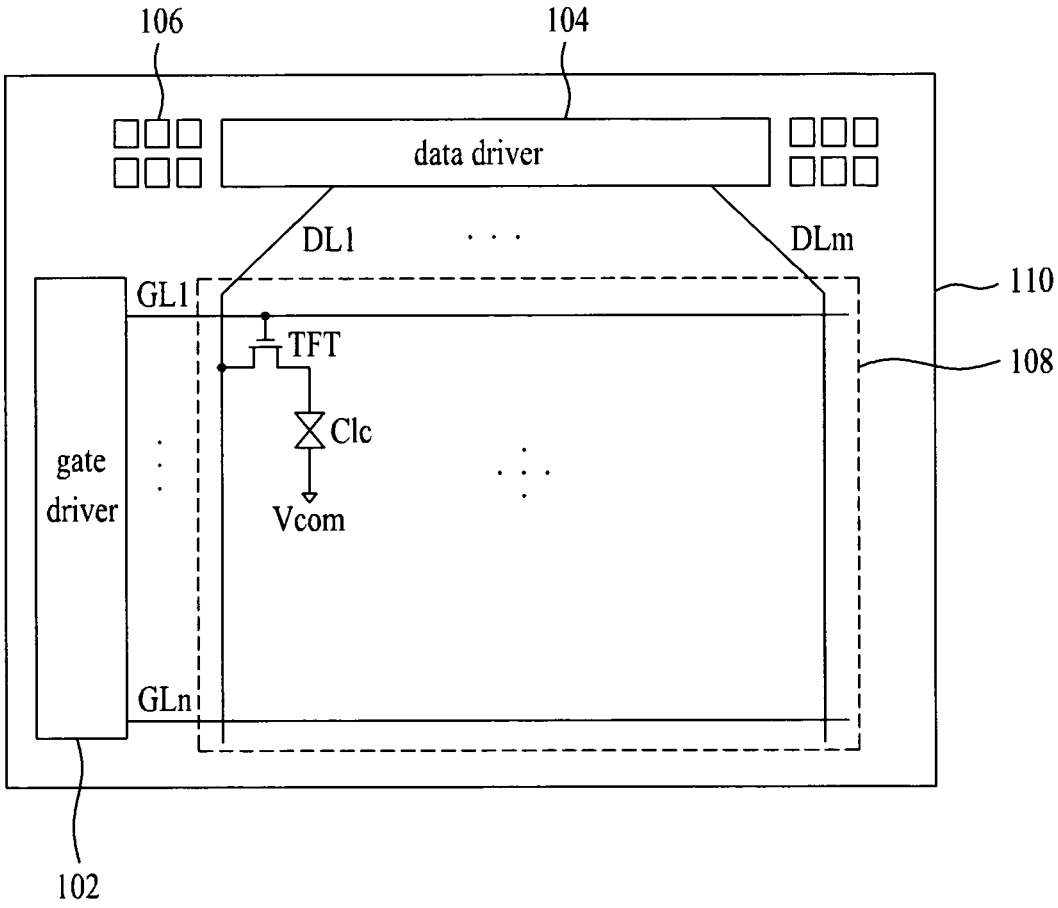
FIG. 1 is a block diagram schematically illustrating a liquid crystal display according to the present invention.
Figure 2:
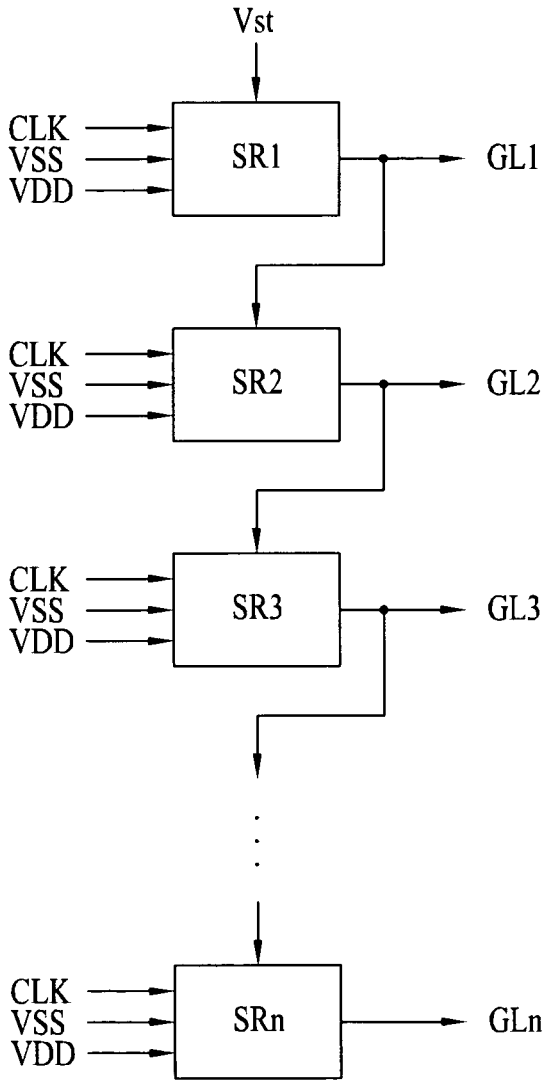
FIG. 2 is a block diagram showing details of a gate driver of the liquid crystal display device shown in FIG. 1.

FIG. 1 is a block diagram showing a liquid crystal display according to the present invention.

Referring to FIG. 1, the liquid crystal display according to the present invention includes a liquid crystal display panel 110 having an image display unit 108, a data driver for driving data lines DL of the image display unit 108, and a gate driver 102 for driving gate lines GL of the image display unit 108.

The data driver 104 generates pixel data signals for one horizontal line in every horizontal period in response to data control signals from a timing controller. In particular, the data driver 104 converts digital pixel data R, G and B from the timing controller into analog pixel data signals using a gamma voltage from a gamma voltage generator and outputs the analog pixel data signals. The data driver 104 is mounted on the liquid crystal display panel 110 by a chip-on-glass method, and is mounted on a signal transmission film connected to the liquid crystal display panel 110 or is simultaneously formed in a common process with thin film transistors (TFTs) formed in the image display unit 108 and integrated in a peripheral region of the liquid crystal display panel 110.

The gate driver 102 may be integrated and formed in the peripheral region of the liquid crystal display panel 110. The gate driver 102 is simultaneously formed in a common process with the TFTs formed in the image display unit 108 of the liquid crystal display panel 110. Either an amorphous silicon TFT or a polysilicon TFT having high charge mobility may be used in the TFTs formed in the gate driver 102. For example, the gate driver 102 may be integrated in the peripheral region of the liquid crystal display panel 110 using an NMOS thin film transistor, a PMOS thin film transistor, or a CMOS thin film transistor.

The gate driver 102 may be formed on one side of the peripheral region of the liquid crystal display panel 110 or on both sides of the peripheral region of the liquid crystal display panel 110 to prevent signal delay that may occur because the gate lines GL lengthen as the liquid crystal display panel 110 enlarges.

The gate driver 102 generates scan signals in every horizontal period in response to the gate control signals from the timing controller. The gate driver 102 includes first to nth stages (shift registers) SR1 to SRn for sequentially supplying the scan signals to first to nth gate lines GL1 to GLn.

The first to nth stages SR1 to SRn generate normal scan signals in a normal mode and generate test scan signals in a test mode.

In more detail, in the normal mode, first and second power source voltages VSS and VDD and a plurality of clock signals CLK are selectively supplied to the first to nth stages SR1 to SRn and a start signal Vst having a high logic level and output signals of previous stages SR1 to SRn-1 are respectively supplied to the first to nth stages SR1 to SRn. The first stage SR1 outputs a normal scan signal, that is, a scan signal Von having a high logic level, to the first gate line GL1 in response to the start pulse Vst having the high logic level and the clock signal CLK. The second to nth stages SR2 to SRn sequentially output scan signals Von having the high logic level to the second to nth gate lines GL2 to GLn in response to the output signals of the previous stages SR1 to SRn-1 and the clock signals CLK, respectively.

Figure 3:
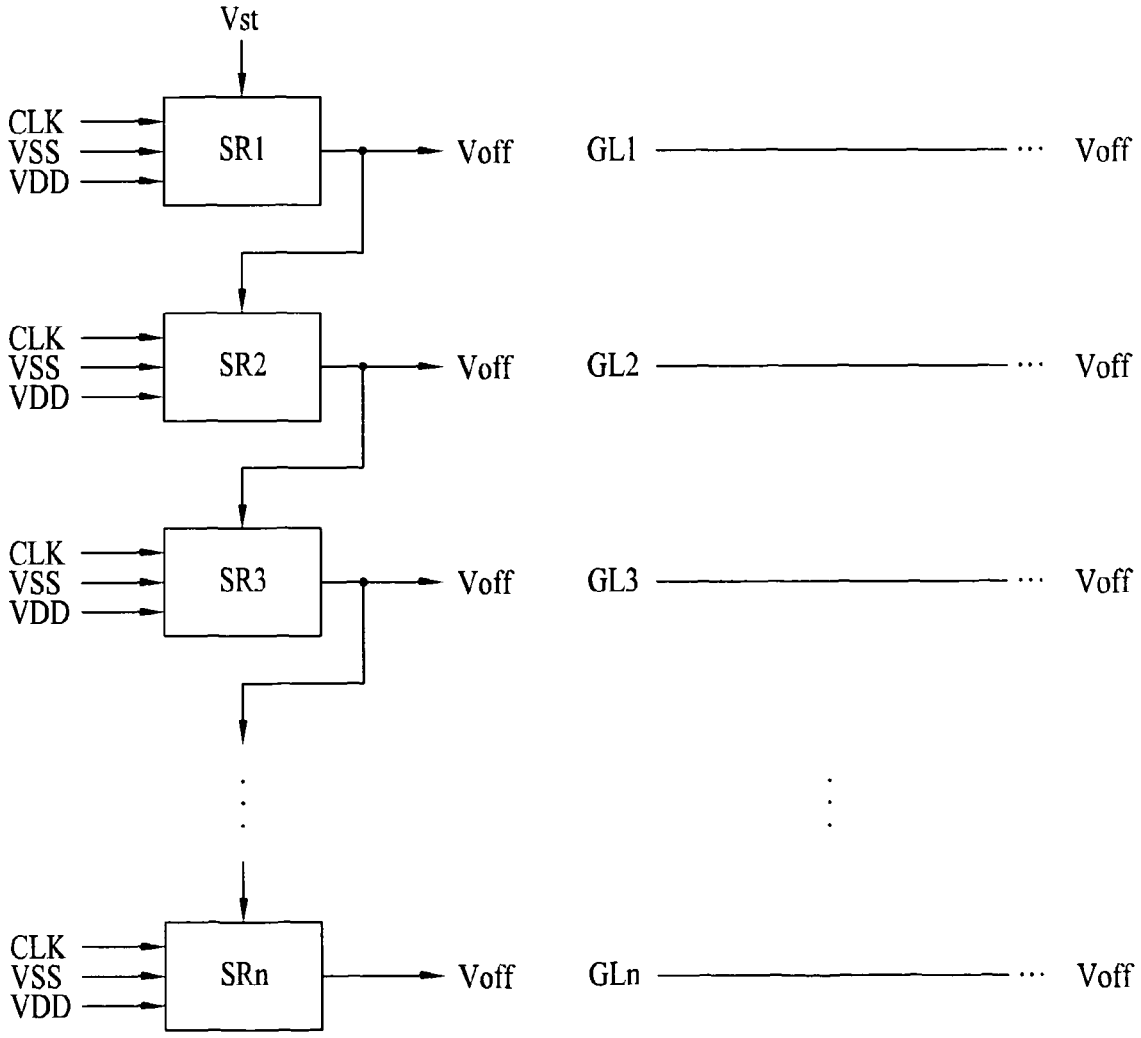
FIG. 3 is a block diagram showing test scan signals generated by a plurality of stages of the gate driver shown in FIG. 2 in a normal mode.

In the test mode, first and second power source voltages VSS and VDD and the plurality of clock signals CLK are selectively supplied to the first to nth stages SR1 to SRn and a start signal Vst having a low logic level and output signals of previous stages SR1 to SRn-1 are respectively supplied to the first to nth stages SR1 to SRn. As shown in FIG. 3, the first stage SR1 outputs a test scan signal, that is, a scan signal Voff having a low logic level, to the first gate line GL1 in response to the start pulse Vst having the low logic level and the clock signal CLK. The second to nth stages SR2 to SRn sequentially output scan signals Voff having the low logic level to the second to nth gate lines GL2 to GLn in response to the scan signals Voff having the low logic level of the previous stages SR1 to SRn-1 and the clock signals CLK, respectively.

If a faulty (bad) stage is not included in the first to nth stages SR1 to SRn, the first to nth stages SR1 to SRn output the scan signals Voff having the low logic level.

Figure 4:
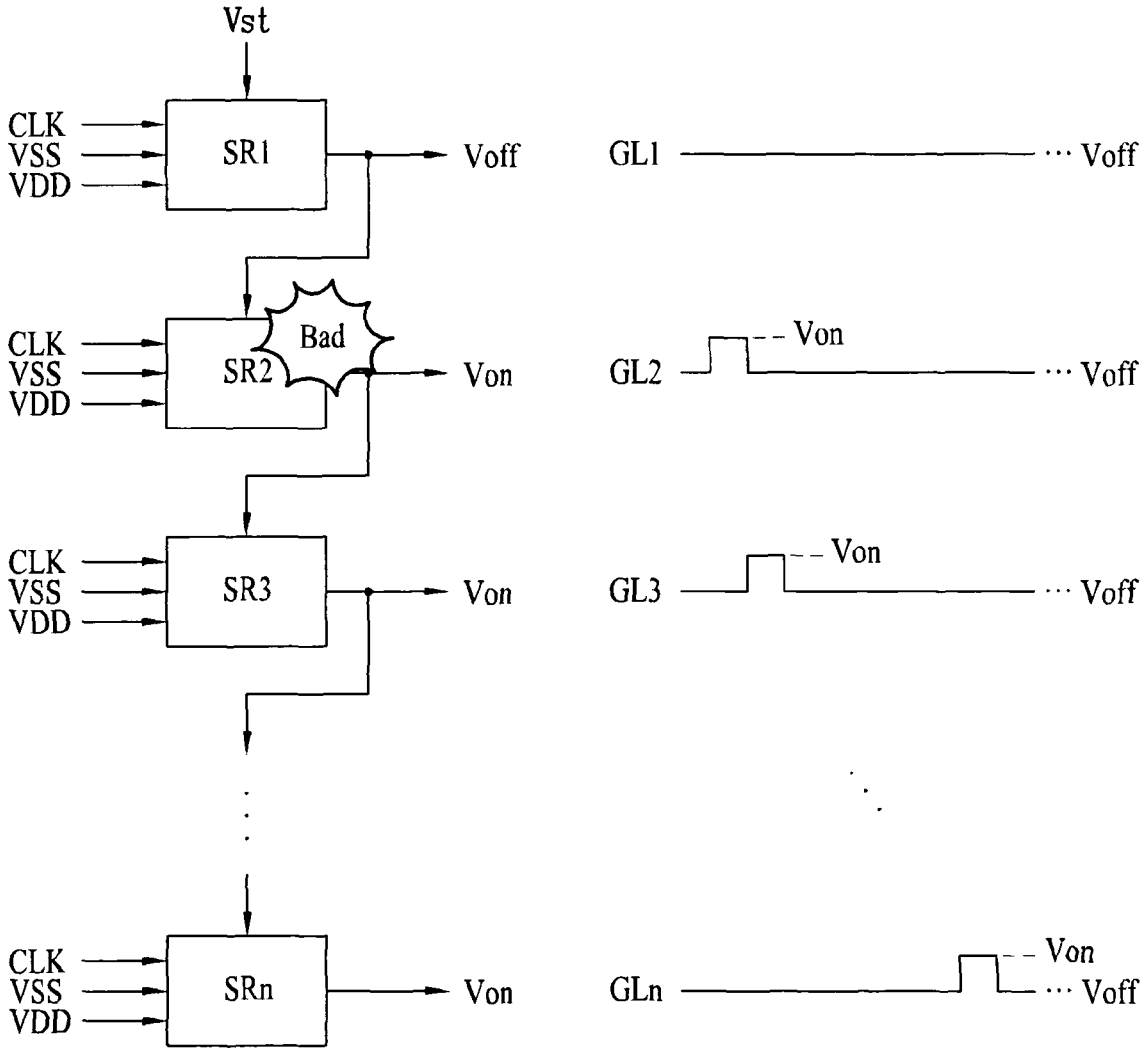
FIG. 4 is a block diagram showing test scan signals generated by a plurality of stages when a failure occurs in a second stage among the plurality of stages shown in FIG. 2.

By contrast, if at least one faulty stage SR is included in the first to nth stages SR1 to SRn, as shown in FIG. 4, a normal stage SR that is located at the stage previous stage to the faulty stage SR outputs the scan signal Voff having the low logic level and the faulty stage SR to the last stage SR each outputs the scan signals Von having the high logic level. For example, if the second stage SR2 is faulty, the second to nth stages SR2 to SRn output the scan signals Von having the high logic level.

In the image display unit 108 of the liquid crystal display panel 110, as illustrated in FIG. 1, TFTs and liquid crystal cells Clc connected to the TFTs are formed in areas formed at crossings between the gate lines GL and the data lines DL.

Since each of the liquid crystal cells Clc includes a pixel electrode connected to the TFT and a common electrode that is formed on the pixel electrode with liquid crystal interposed therebetween and forms an electric field with the pixel electrode, each of the liquid crystal cells Clc may be represented by a liquid crystal capacitor Clc. A difference voltage between a pixel data signal supplied via the TFT and a common voltage Vcom is charged in each liquid crystal cell Clc and the liquid crystal is driven according to the charged voltage, such that light transmission is adjusted.

A plurality of test pads 106 are formed in the peripheral region excluding the image display unit of the liquid crystal display panel 110. The first and second power source voltages VSS and VDD, the plurality of clock signals CLK and the start pulse Vst having the low logic level are supplied to the gate driver 102 via the test pads 106 in the test process.

In the liquid crystal display panel 110, if a faulty stage is not included in the first to nth stages SR1 to SRn in the test mode, the TFTs connected to the first to nth gate lines GL1 to GLn are turned off in response to the scan signals having the low logic level that are generated by the first to nth stages SR1 to SRn. The liquid crystal display panel 110 displays a white image (normally white mode) or a black image (normally black mode) regardless of the pixel data signals supplied to the data lines DL.

Figure 5A:
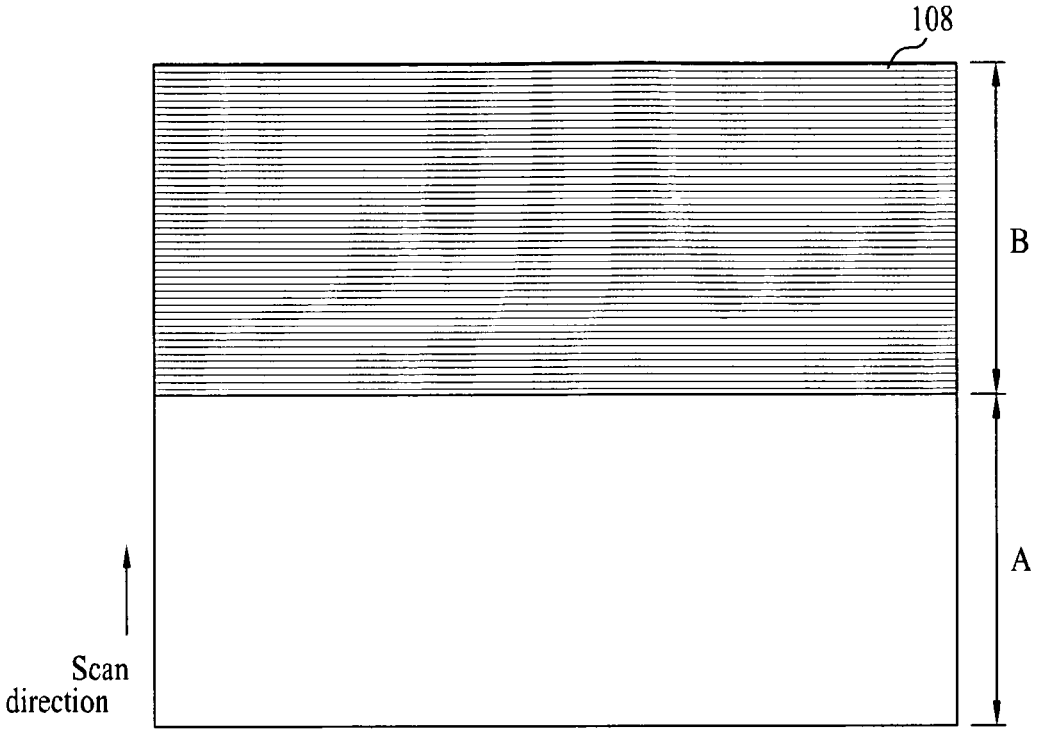
FIG. 5A is a view showing an image displayed on an image display unit when a failure occurs in any one of a plurality of stages, in a liquid crystal display of a normally white mode.
Figure 5B:
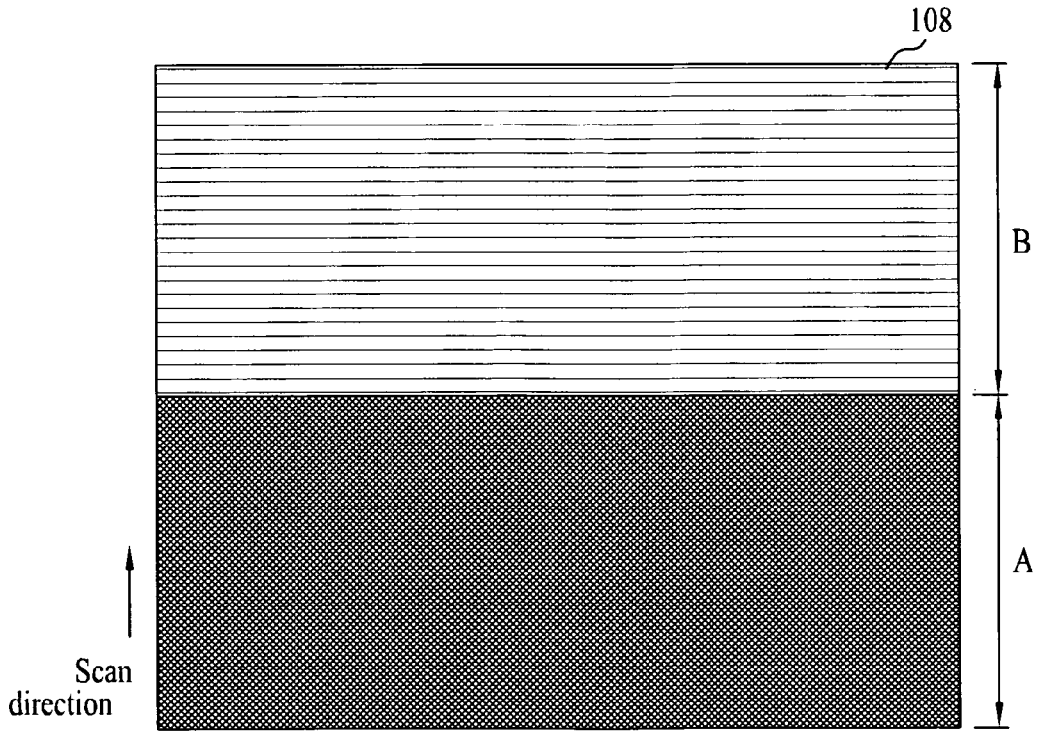
FIG. 5B is a view showing an image displayed on an image display unit when a failure occurs in any one of a plurality of stages, in a liquid crystal display of a normally black mode.

By contrast, in the liquid crystal display panel 110, as shown in FIGS. 5A and 5B, if any one of the first to nth stages SR1 to SRn is faulty in the test mode, a previous region A and a next region B of the faulty stage SR are displayed to be different from each other.

That is, the TFTs connected to the gate lines of the region A corresponding to the normal stage SR are turned off in response to the scan signals having the low logic level from the normal stage. The region A corresponding to the normal stage SR of the liquid crystal display panel 110 displays the white image or the black image regardless of the pixel data signals supplied to the data lines DL.

The TFTs connected to the gate lines of the region B corresponding to the faulty stage SR and stages following the fault stage are turned on in response to the scan signals having the high logic level from the faulty stage SR and the stages SR located at the next stage of the faulty stage SR. The pixel data signals supplied to the data lines DL via the turned-on TFTs are supplied to the liquid crystal cells Clc such that the region B corresponding to the faulty stage SR of the liquid crystal display panel 110 displays images corresponding to the pixel data signals.

Figure 6:
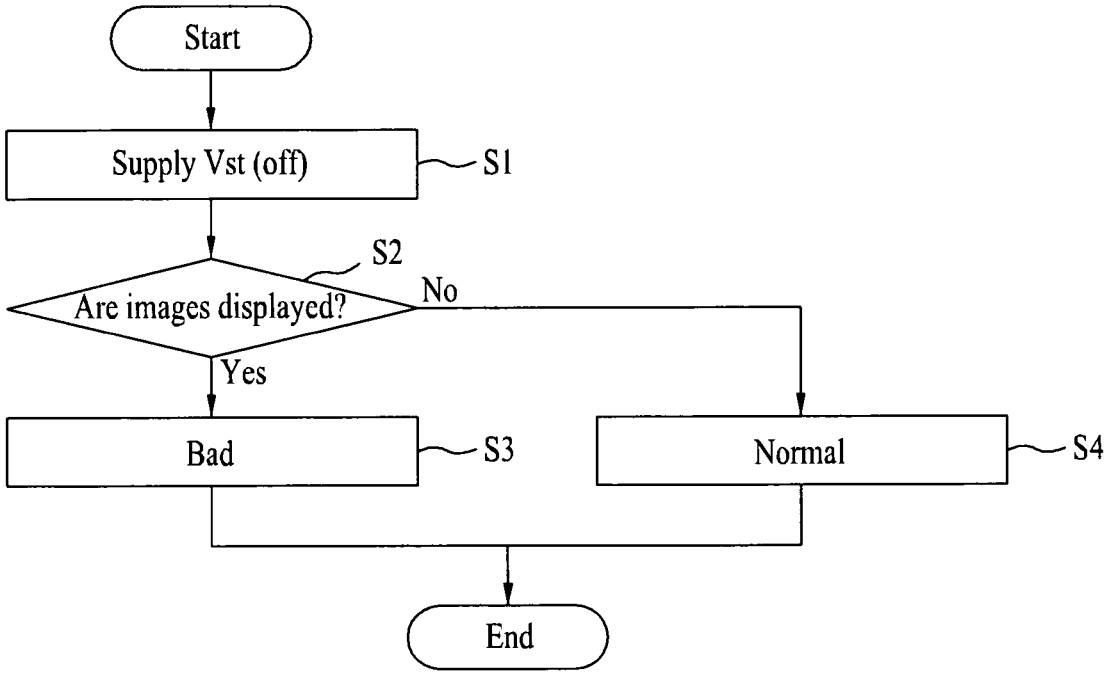
FIG. 6 is a flowchart illustrating a method of testing a liquid crystal display according to the present invention.

FIG. 6 is a flowchart illustrating a method of testing a liquid crystal display according to the present invention.

First, the start pulse Vst (off) having the low logic level, the first and second power source voltages VDD and VSS, the plurality of clock signals CLK are supplied to the first stage SR1 of the completed liquid crystal display via the test pad (step S1). The output signals of the previous stages, the first and second power source voltages VDD and VSS and the clock signals CLK are supplied to the second to nth stages SR2 to SRn via the test pads 106, respectively.

The first to nth stages SR1 to SRn sequentially supply DC test scan signals, that is, the scan signals having the low logic level, to the first to nth gate lines GL1 to GLn in response to the input signals. The TFTs of the image display unit are turned off in response to the test scan signals. Then, the pixel data signals are supplied to the first to mth data lines DL1 to DLm.

Thereafter, it is determined whether or not the images corresponding to the pixel data signals are displayed on the image display unit 108 of the liquid crystal display panel (step S2). If it is determined that the images corresponding to the pixel data signals are displayed on the image display unit 108, it can be determined which of the plurality of stages SR is faulty. That is, it is determined that the stage SR connected to the gate line GL corresponding to a first crystal cell of the liquid crystal cells Clc that display the images corresponding to the pixel data signals is faulty (step S3). When the black or white image is displayed on the image display unit 108 regardless of the pixel data signals, it is determined that all the plurality of stages SR are good (step S4).

After determining whether or not a failure occurs in the gate driver 102, it is determined whether or not a failure occurs in the liquid crystal cells Clc. Alternatively, the determination of whether or not a failure occurs in the liquid crystal cells Clc may be made before determining whether or not a failure occurs in the gate driver 102.

Hereinafter, the method of determining whether or not the failure occurs in the liquid crystal cells Clc will be described in detail.

First, the scan signals having the high logic level are simultaneously supplied to the first to nth gate lines GL1 to GLn via the gate driver 102 such that the TFTs of the image display unit are simultaneously turned on. Red data signals are supplied from the data lines DL corresponding to red liquid crystal cells Clc to the red liquid crystal cells Clc via the turned-on TFTs. In response to the application of red data signals, a normal red liquid crystal cell Clc displays a red image and a faulty red liquid crystal cell Clc displays a black or white image. Green data signals are supplied from the data lines DL corresponding to green liquid crystal cells Clc to the green liquid crystal cells Clc via the turned-on TFTs. In response to the application of green data signals, a normal green liquid crystal cell Clc displays a green image and a faulty green liquid crystal cell Clc displays a black or white image. Blue data signals are supplied from the data lines DL corresponding to blue liquid crystal cells Clc to the blue liquid crystal cells Clc via the turned-on TFTs. In response to the application of, a normal blue liquid crystal cell Clc displays a blue image and a faulty blue liquid crystal cell Clc displays a black or white image.

Although the gate driver formed of TFTs that are simultaneously formed with the TFTs formed in the image display unit is described in the liquid crystal display according to the present invention, the present invention is applicable to a data driver formed of TFTs that are simultaneously formed with the TFTs formed in the image display unit.

As described above, in the liquid crystal display and the method of testing the same according to the present invention, a plurality of stages sequentially generate scan signals having a low logic level in a test mode. Accordingly, a region of an image display unit corresponding to a normal stage displays a black or white image and a region of the image display unit corresponding to a faulty stage and subsequent stages displays images corresponding to data signals. Therefore, it is possible to easily detect which of the plurality of stages is faulty, using the image displayed on the image display unit. Accordingly, it is possible to prevent a faulty liquid crystal display from occurring and facilitate failure analysis.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A liquid crystal display comprising:

a liquid crystal display panel on which liquid crystal cells connected to thin film transistors (TFTs) located at crossings between gate lines and data lines are formed;

a data driver that drives the data lines of the liquid crystal display panel; and a gate driver that includes a sequence of first to nth stages of shift registers configured to supply scan signals to first to nth gate lines $GL_1$ to $GL_n$, wherein n is a natural number larger than 1, formed on the liquid crystal display panel, wherein the first to nth stages of the shift registers generate normal scan signals for turning on the TFTs in a normal mode, and generate test scan signals in a test mode detecting a failure of the gate driver, wherein, in the test mode, the first to nth stages generate the test scan signals having a low logic level for turning off the TFTs when a faulty stage is not included in the first to nth stages, and the faulty stage to the nth stage generate the test scan signals having a high logic level for turning on the TFTs when at least one of the faulty stage is included in the first to nth stages, wherein, in the test mode, the first stage of the sequence of first to nth stages of the shift registers outputs the test scan signal to the first gate line in response to a start pulse having a low logic level and a clock signal supplied from test pads located in a peripheral region of the liquid crystal display panel, and the second to nth stages of the shift registers output the test scan signal, to the second to nth gate lines in response to output signals of the previous stages of the shift registers and clock signals, and wherein, in the test mode, a black or white image regardless of a pixel data signal supplied to the data line is displayed in a region of the liquid crystal display panel corresponding to the first stage to the stage previous to the faulty stage in the sequence of stages when a faulty stage is not included in the first to nth stages.

2. The liquid crystal display according to claim 1, wherein:

images corresponding to pixel data signals supplied to the data lines are displayed in a region of the liquid crystal display panel corresponding to the faulty stage to the nth stage.

3. A method of testing a liquid crystal display including a liquid crystal display panel on which liquid crystal cells connected to thin film transistors (TFTs) located at crossings between gate lines and data lines are formed, the method comprising:

generating test scan signals by a gate driver including a sequence of first to nth stages of shift registers formed on the liquid crystal display panel in a test mode detecting a failure of the gate driver, wherein n is a natural number greater than 1;

sequentially supplying test scan signals to the first to nth gate lines of the liquid crystal display panel;

supplying pixel voltage signals to the data lines of the liquid crystal display panel; and determining whether or not images corresponding to the pixel voltage signals are displayed on the liquid crystal display panel, wherein, in the test mode, the first to nth stages of the shift registers generate the test scan signals having a low logic level for turning off the TFTs when a faulty stage is not included in the first to nth stages of the shift registers, and the faulty stage to the nth stage generate the test scan signals having a high logic level for turning on the TFTs when at least one of the faulty stage is included in the first to nth stages, wherein, in the test mode, the first stage of the shift registers outputs a test scan to the first gate line in response to a start pulse having a low logic and a clock signal supplied from test pads located in a peripheral region of the liquid crystal display panel, and the second to nth stages of the shift registers output test scan signals to the second to nth gate lines in response to output signals of the previous signals of the shift registers and clock signals, and wherein, in the test mode, a black or white image regardless of a pixel data signal supplied to the data line is displayed in a region of the liquid crystal display panel corresponding to the first stage to the stage previous to the faulty stage in the sequence of stages when a faulty stage is not included in the first to nth stages.

4. The method according to claim 3, wherein the determining of whether or not the images corresponding to the pixel voltage signals are displayed comprises determining the gate driver to be faulty if it is determined that the images corresponding to the pixel voltage signals are displayed on the liquid crystal display panel and determining the gate driver to be good if it is determined that the black or white image is displayed on the liquid crystal display panel.

* * * * *